United States Patent [19]

Sears et al.

[11] Patent Number: 4,580,461

[45] Date of Patent: Apr. 8, 1986

[54] BIAX GIMBAL ARRANGEMENT

[75] Inventors: James T. Sears; Harrison B. Albert, both of Boulder, Colo.

[73] Assignee: Ball Corporation, Muncie, Ind.

[21] Appl. No.: 480,753

[22] Filed: Mar. 31, 1983

[51] Int. Cl.[4] ..... H01Q 3/08

[52] U.S. Cl. ..... 74/479; 74/89.22; 343/765

[58] Field of Search ..... 343/765, 766, 882, 883; 74/1 R, 89.22, 99 R, 479

[56] References Cited

U.S. PATENT DOCUMENTS

| | | | |
|---|---|---|---|
| 1,932,469 | 10/1933 | Leib et al. . | |
| 2,512,636 | 4/1950 | Flynt . | |
| 2,700,106 | 1/1955 | Taylor . | |
| 2,740,962 | 4/1956 | Hammond, Jr. . | |
| 2,786,361 | 3/1957 | Russell | 343/766 |
| 2,924,824 | 2/1960 | Lanctot et al. . | |
| 2,994,877 | 8/1961 | DeMott et al. | 74/1 |
| 3,202,015 | 8/1965 | Moul et al. | 343/757 |
| 3,374,977 | 3/1968 | Moy | 343/883 |
| 3,987,452 | 10/1976 | Godet . | |
| 4,020,491 | 4/1977 | Bieser et al. . | |
| 4,238,802 | 12/1980 | Speicher . | |
| 4,392,140 | 7/1983 | Bastian et al. | 343/765 |
| 4,396,919 | 8/1983 | Speicher | 343/765 |

FOREIGN PATENT DOCUMENTS

| | | | |
|---|---|---|---|
| 447786 | 11/1974 | U.S.S.R. | 343/765 |

*Primary Examiner*—Eli Lieberman

*Attorney, Agent, or Firm*—Gilbert E. Alberding

[57] ABSTRACT

A biax gimballing arrangement permitting both axes of rotation to intersect at a point within a load being gimbaled, thereby permitting the rotational inertia of the load and the gimbal mechanism itself to be minimized. Gimbal rotation about a first axis is achieved by a first drive motor. Rotation in a second axis orthogonal to the first axis is achieved by a steel cable drive assembly having two drive cable ends that are passed through the first rotational axis on their way to respective anchor points within a portion of the gimbal apparatus that is rotated about the first axis. This rotatable portion of the gimbal apparatus includes milled guideways which permit rotation of the gimbal load mount. The central portion of the cable is driven by engagement with a pulley attached to the shaft of a second drive motor.

20 Claims, 6 Drawing Figures

BIAX GIMBAL ARRANGEMENT

BACKGROUND OF THE INVENTION

This invention relates to gimballing arrangements. It may, for example, be used for scanning and tracking antennas and the like. The present invention provides a biaxial (biax) gimbal mounting arrangement permitting both axes of rotation to intersect at a point within the load being gimballed.

Gimbal mounts are widely utilized for, among other things, antennas and optical transducers. For many applications, it is desirable to scan the antenna or transducer in a predetermined manner so as to monitor a predetermined sector of space. In other applications it is desirable to track a target. As the target moves, the antenna or optical transducer must be moved so as to maintain the target within a narrow beam of the antenna or optical transducer being gimballed. The patent literature is replete with various types of arrangements for gimballing antennas. The following is merely a small sample of the patent literature and is not intended to be an exhaustive list.

U.S. Pat. No. 1,932,469—Leib et al (1933)
U.S. Pat. No. 2,512,636—Flynt (1950)
U.S. Pat. No. 2,700,106—Taylor (1955)
U.S. Pat. No. 2,740,962—Hammond, Jr. (1956)
U.S. Pat. No. 2,924,824—Lancott et al (1960)
U.S. Pat. No. 3,987,452—Godet (1976)
U.S. Pat. No. 4,020,491—Bieser et al (1977)
U.S. Pat. No. 4,238,802—Speicher (1980)

Of the patents listed above, the Leib et al U.S. Pat. No. 1,932,469, Flynt U.S. Pat. No. 2,512,636, Taylor U.S. Pat. No. 2,700,106, Lancott et al U.S. Pat. No. 2,924,824 and Bieser et al U.S. Pat. No. 4,020,491 all disclose gimballing arrangements that have the inherent capability to rotate an attached load about its center of gravity. However, significant amounts of extraneous mechanism must be provided in order to accomplish this result. This may increase power requirements typically necessary to carry out a high speed scan. These patents teach azimuth-elevation or conical scan gimbals vis-a-vis the biax scan gimbal arrangement described herein. Conical scan gimbals have significant drawbacks compared with biax scan gimbals.

Conical scan gimbals rotate their load about its line of sight in the process of pointing the load toward a target. This may sometimes preclude the use of a polarized antenna, such as a radar antenna or a polarized optical sensor or an imagine sensor. In addition, conical scan gimbals may be unsuitable for very sensitive simple monopulse radar techniques in which an antenna is constructed to provide left-right, up-down error signals in an acquisition track mode of operation.

The Hammond U.S. Pat. No. 2,740,962 and Speicher U.S. Pat. No. 4,238,802 patents disclose biax gimbals that rotate a load about its center of gravity. However, in both cases, the load, i.e., the antenna, is small enough to fit in a cage or is counter balanced. The Hammond, Jr. U.S. Pat. No. 2,740,962 arrangement requires a rather large envelope and the Speicher U.S. Pat. No. 4,238,802 arrangement appears structurally compliant and weak. Both move significant amounts of mechanism along with the load.

The Godet U.S. Pat. No. 3,987,452 arrangement discloses a rather complex biax gimbal. However, it may have a high inertial load and vibration sensitivity due to the swinging action that is produced in pointing.

SUMMARY OF THE INVENTION

The present invention provides a gimbal mounting arrangement which provides at least two rotational axes about which an attached load may be gimballed. The attached load may typically be an antenna, an optical transducer, or the like. Of course, the arrangement could be easily adapted to gimbal virtually any desired load structure. There is virtually no limit to the possible range of scale—i.e. big or small. It may be used for pointing solar mirrors, for instance. It may also comprise (e.g. with the addition of gravity sensors) a vertically stabilized platform capable of supporting a man (e.g. on an ocean-going search and rescue mission).

The gimballing arrangement described herein permits both axes of rotation to intersect at a point within the load being gimbaled. Thus, the rotational inertia of the load and of the gimbal mechanism itself may be minimized. This arrangement also permits minimum overall containment envelope dimensions for the gimbal and its load. Because the rotational inertia is minimized, relatively rapid scan rates are permitted using only relatively low powered drive inputs.

The structure is also relatively simple so as to facilitate low-cost production while at the same time it is relatively free of required structural material along the central axis of the gimbal mechanism, thus facilitating its usage in special situations where other apparatus must be co-located with the gimbal mechanism.

One important feature of this invention which greatly facilitates these desirable results is a rod and pulley assembly coaxial with one rotational axis of the load. A drive cable for another rotational axis of the load passes over this pulley near the first rotational axis. Thus the cable leaves the pulley at a direction determined by the disposition of the load about this first axis and provides a very convenient and advantageous drive about the second axis.

Gimbal rotation about a first axis (fixed with respect to motor drive units providing power, etc.) is achieved in the exemplary embodiment by a pair of outboard push rods having a ball joint at either end. These push rods are controlled by a first drive motor through, for example, opposite ends of a lever arm which is affixed at its center to the shaft of a push rod drive motor. Rotation in the second orthogonal axis is achieved by a steel cable drive assembly having two drive cable ends that are passed through the first rotational axis on their way to respective anchor points within a portion of the gimbal apparatus that is rotated about the first rotational axis. This rotatable portion of the gimbal apparatus includes milled guideways which permit orthogonal rotation motion of the gimbal load mount. The central portion of the cable is driven by engagement with a pulley attached to a shaft of a cable drive assembly motor.

Specifically, the present exemplary embodiment provides a biaxial gimbal mounting arrangement for gimballing a load in two rotational axes comprising: a rigid frame, two support members rigidly attached to the frame, a block member adapted to receive the load and having a grooved arc therethrough, the block member for supporting said load, a pair of rod and pulley assemblies coupled one each to the support members and at least partially within the grooved arc, a line between said rod and pulley assemblies defining a first axis for rotation of the block member, a rod driving motor rigidly attached to the frame for providing power to rotate the block member about the first axis, a rod drive arm pivotally attached to the frame and coupled to the rod driving motor so as to be pivoted with the rotation of the rod driving motor, a pair of push rod and ball joint assemblies each having a first end coupled to the rod drive arm and each having a second end attached to the block member, the points of attachment to the block member forming a second axis for rotation of the block member orthogonal to the first axis, a cable motor rigidly coupled to the frame for providing power to rotate the block member about the second axis, rotation of the block member about the second axis, changing the relative position of the rod member within the grooved arc, and a cable arrangement for transmitting power from the cable motor to the block member for rotating the block member about the second axis.

To describe the exemplary embodiment in other words, it provides a biaxial gimbal arrangement for gimballing a load comprising: a load mount, means defining two orthogonal axes about which the load mount can rotate, a first motor, drive means coupled to the first motor and to the load mount for rotating the load mount about the first axis, a second motor, and cable means coupled to the second motor and to the load mount for rotating the load bearing member about the second axis.

The biax gimballing arrangement described herein allows rapid mechanical scanning or tracking of a target object with any of a variety of sensors attached as the gimbaled load. The sensors may be millimeter radar arrays, active and passive optical sensors or any other types of desired devices. The exemplary arrangement offers several significant operational advantages over known gimbal arranngements such as those described in the above-discussed patent literature.

The geometry of the gimballing arrangement allows for a wide angular deflection of the load without any swinging action. This permits the dimensions of the containment envelope to be minimized. The rotational inertia of the load is minimized and is not significantly added to by the mechanism which allows rapid scanning with minimum power usage. The structural arrangement permits the central axis of the mechanism to be kept relatively free of structural material. Also, the simplicity of the mechanism permits low cost production compared with more complex arrangements.

BRIEF DESCRIPTION OF THE DRAWINGS

The invention will be further described in connection with the drawings wherein.

DETAILED DESCRIPTION OF THE PREFERRED EMBODIMENT

Figure 1:
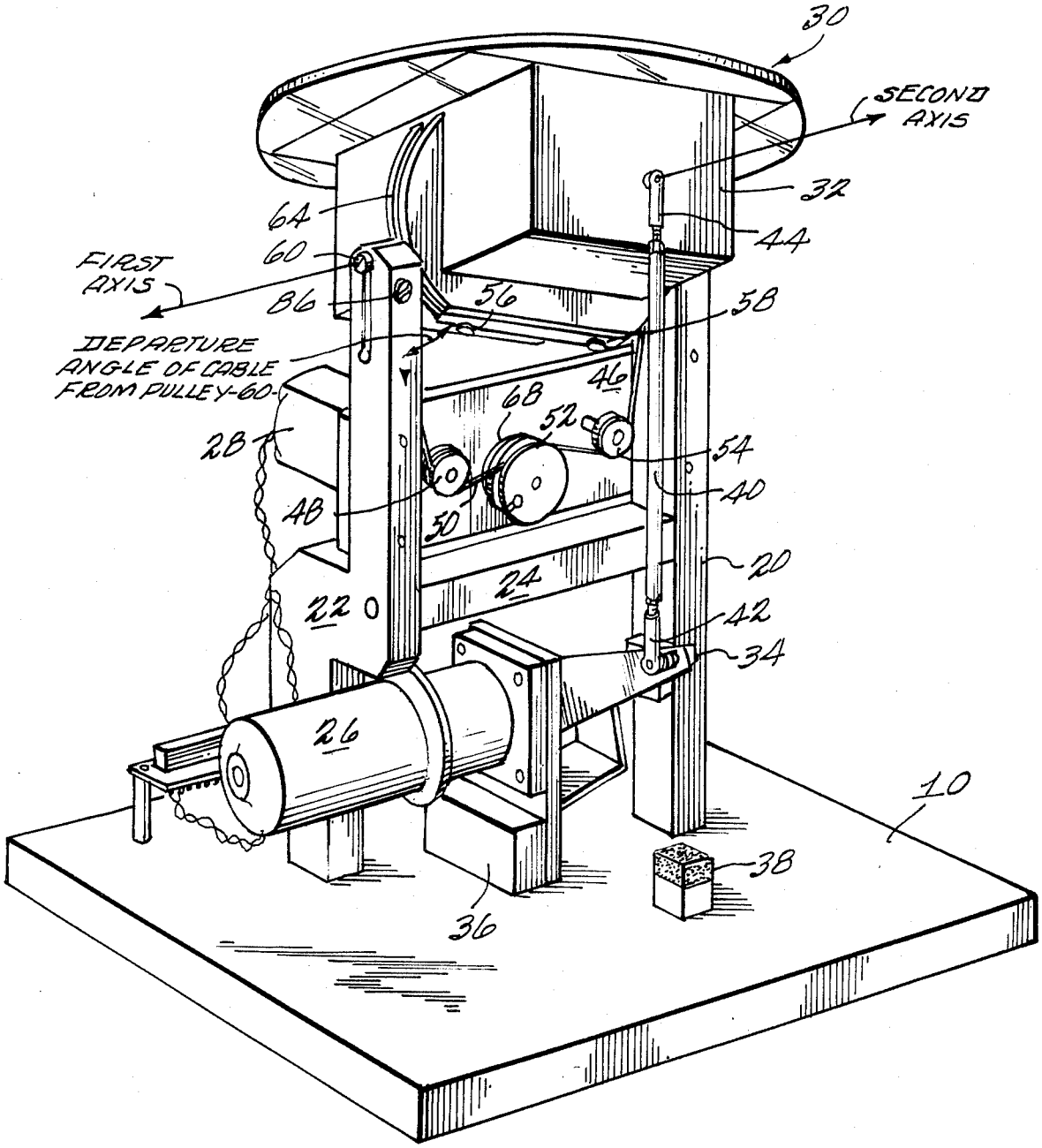
FIG. 1 is a perspective view of an exemplary biaxial gimballing arrangement.

Referring now to FIG. 1 there is shown a perspective view of an exemplary biax gimballing arrangement according to the present invention. The foundation of the structure is a base plate 10 to which various structural components are rigidly attached. Vertical members 20 and 22, rigidly attached to base plate 10 provide a firm structure for mounting various components above the base plate. A horizontal member 24 provides structural support and rigidity between members 20 and 22. A push rod drive motor 26 provides drive power for a first of two orthogonal axes over which an attached load can be gimballed. A cable drive assembly motor 28 provides power for gimballing in a second axis orthogonal to the first.

Drive motors 26 and 28 provide power for gimballing a load 30 attached to a load support member or housing 32. Typically, housing 32 will enclose electronic circuitry for processing signals to and/or from load 30 which will typically be an antenna or an optical transducer.

Figure 2:
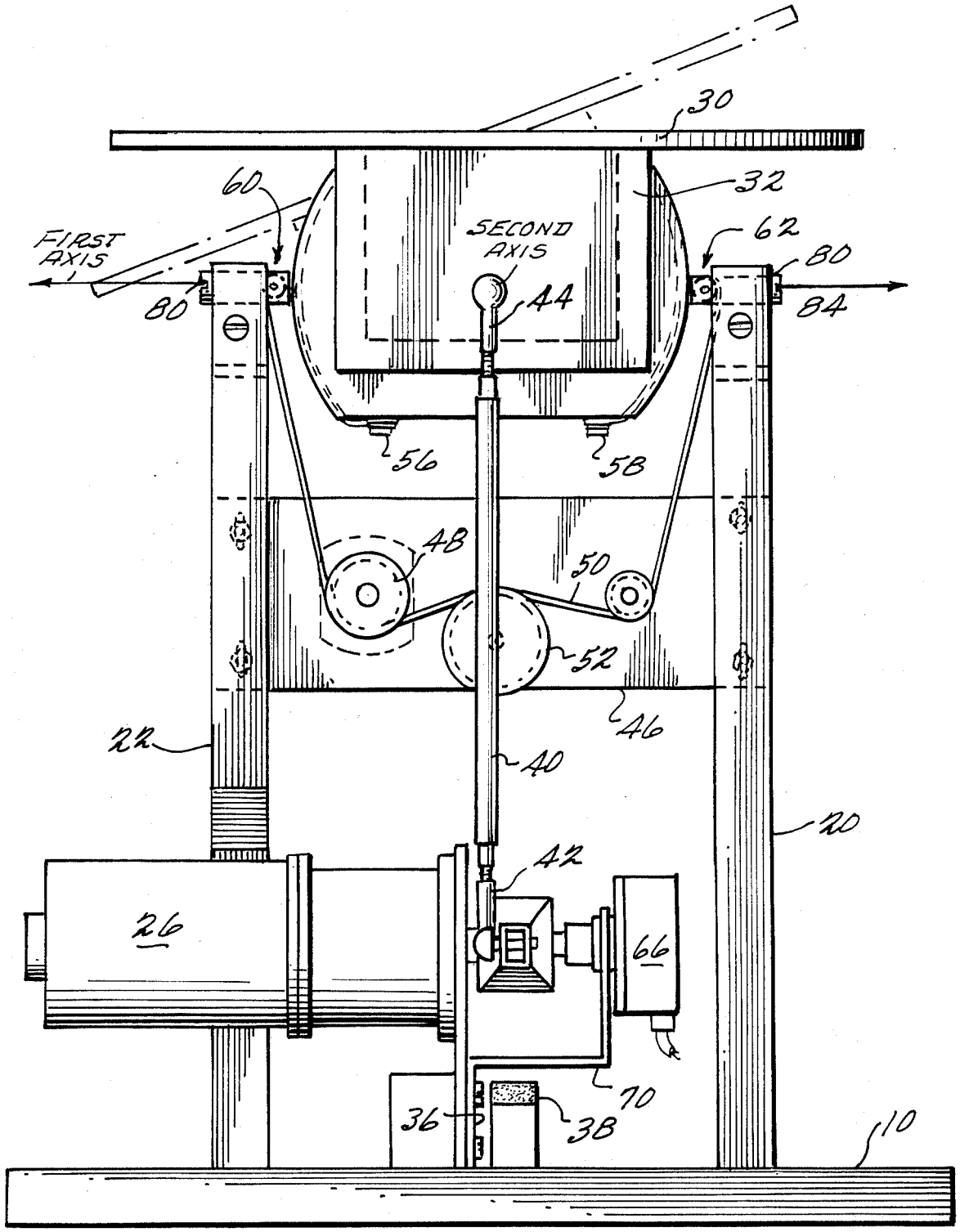
FIG. 2 is a front elevation view of the exemplarly gimballing arrangement of FIG. 1.
Figure 3:
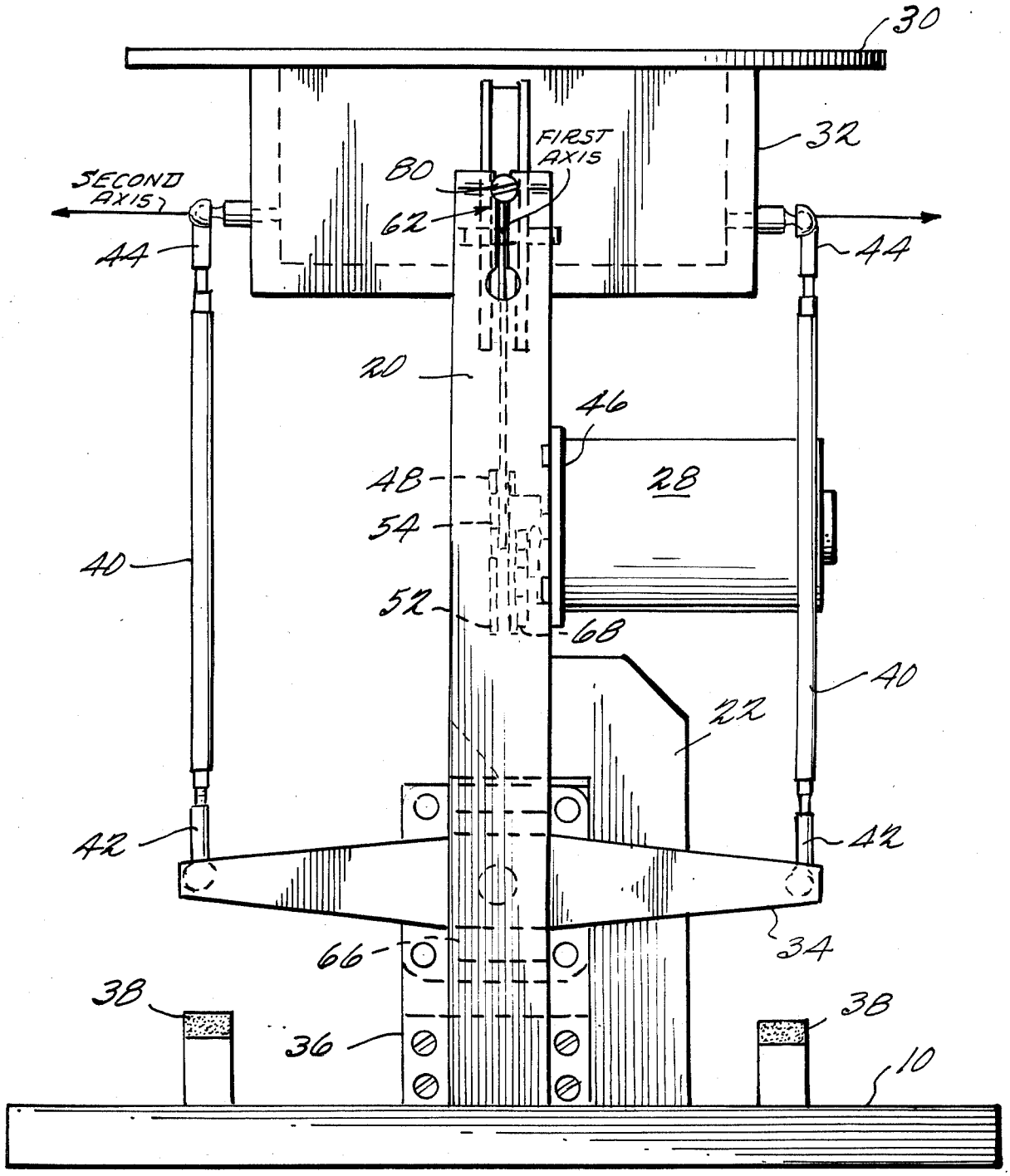
FIG. 3 is a side elevation of the exemplary gimballing arrangement of FIG. 1.

Gimballing about the first axis is accomplished by a mechanism including a rod drive arm 34 attached to a shaft of motor 26. A structural assembly 36, attached to base plate 10, provides support for motor 26 and rod drive arm 34. In operation, motor 26 causes rod drive arm 34 to rotate over a limited arc such that the end of the rod drive arm (visible in FIG. 1) moves up and down. A pair of cushions 38 provide a resting position for the ends of rod drive arm 34. Rod drive arm 34 transmits its power to housing 32 via a pair of rod assemblies 40. Only one of rod assemblies 40 is visible in FIG. 1 and in FIG. 2, but both are shown in FIG. 3.

Rod assemblies 40 are attached at their respective lower ends to opposite ends of rod drive arm 34 with ball joint assemblies 42. Similarly, rod assemblies 40 are attached to housing 32 at their respective upper ends with ball joint assemblies 44. The rotation of rod drive arm 34, transmitted to housing 32 via push rod assemblies 40 causes the housing to rotate about a first axis running through housing 32

Rotation about the second axis orthogonal to the first axis is accomplished by a steel cable drive assembly deriving its power from motor 28. A structural member 46 is attached between vertical members 20 and 22 for supporting motor 28. A shaft of motor 28 is coupled to a drive pulley 48. A steel cable 50 is threaded about drive pulley 48, an idler pulley 52 and an idler pulley 54. Respective ends of cable 50 are passed through the first rotational axis on their way to respective anchor points 56 and 58. The cable ends are passed through the first rotational axis by being looped around miniature rod and pulley assemblies 60 and 62 (shown most clearly in FIG. 2 and in FIGS. 4A–4C). The rotatable portion of housing 32 includes a grooved arc 64 permitting housing 32 to rotate about its second axis defined by the line between the respective points of attachment of ball joint assemblies 40 and 44 to housing 32. The member on which the drive and idler pulleys are mounted is slidably fixed to the vertical structural members so that the cable slack can be easily adjusted.

Figure 4A:
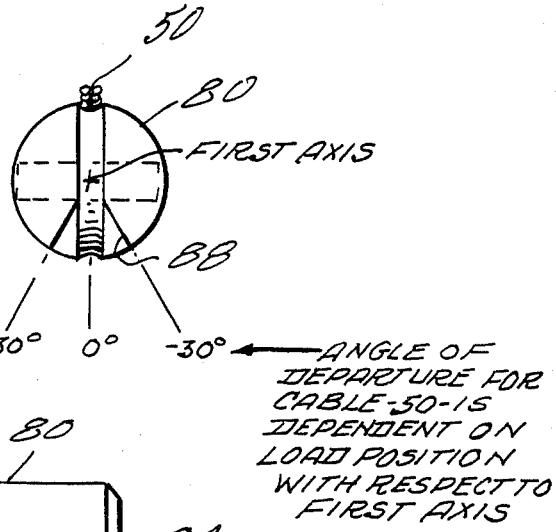
FIGS. 4A, 4B and 4C are end, top and side views respectively of the rod and pulley assemblies used in FIGS. 1–3.
Figure 4B:
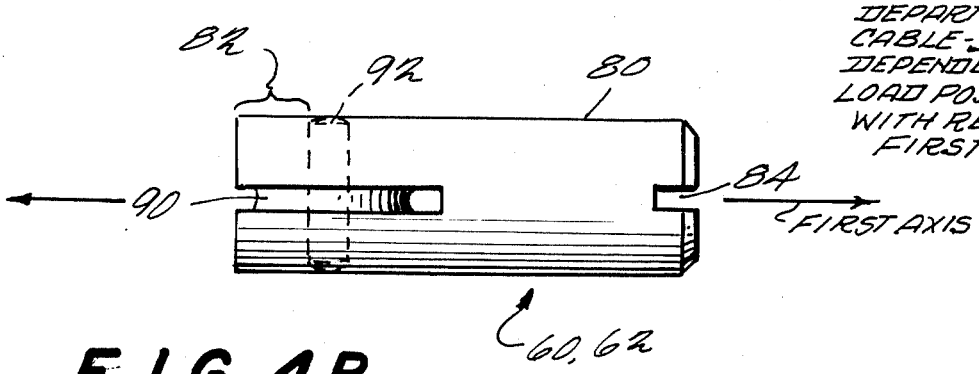
Figure 4C:
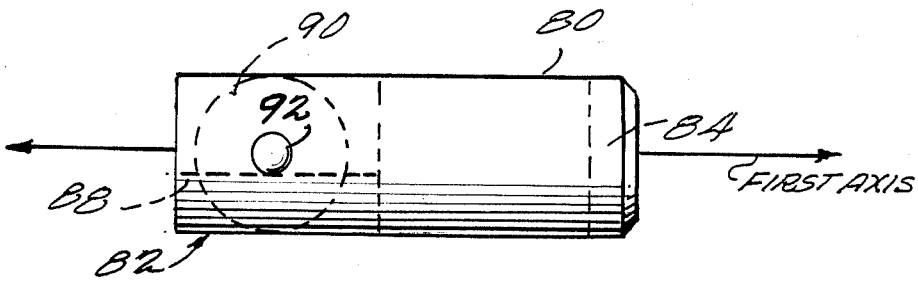

The rod and pulley assembly 60 or 62 is shown in detail at FIGS. 4A–4C. The rod potion 80 may be formed of metal (e.g. brass) and has a cylindrical slider end 82 which is slidably received into the appropriate grooved arc 64 so as to permit rotation about the second gimbal axis. Since the slider end 82 is cylindrical, orthogonal rotation about the first gimbal axis is also permitted. If desired, a non-cylindrical end shape may be employed with a suitable bearing then being provided therewithin to permit rotational motion between the ends of rod 80.

The drive cable 50 passes to connection points 56 or 58 through a flared slot 88 so as to permit cable tracking without encountering sharp edges. The pulley 90 may be made, for example, of Nylon and is rotatably secured in slot 88 by a pin 92.

The respective rotational positions of housing 32 about its two axes are "reported" by a rod potentiometer 66 and a cable potentiometer 68 coupled to one of pulleys 46, 52 or 54 (to pulley 52 in the exemplary embodiment). Rod potentiometer 66 is supported by a structural member 70 and has a shaft rigidly coupled to the shaft of motor 26. By application to an appropriate electrical circuit, a signal can be developed that indicates the rotational position of motor 26. Similarly, cable potentiometer 68 can be coupled to an appropriate electrical circuit for developing a signal indicative of the rotational position of motor 28.

As a result of the geometry of this arrangement, the center of rotation of the load is located at the intersection of lines between the point of attachment of ball joint assemblies 42 and 44 to housing 32 and the line between miniature rod and pulley assemblies 60 and 62. Mechanical advantage between motors 26 and 28 and load 30 allows the use of inexpensive motors. This mechanical advantage is provided in the rod axis by a gear head on motor 26 and on the cable axis by a diameter ratio between grooved arc 64 and drive pulley 48.

Since the rods 40 may be operated only under tension forces (i.e. one or the other may be placed under tension to effect the necessary driving force) they may be replaced by light weight steel cables or other flexible members if desired. In this configuration either the drive arm 34 or individual cable windlasses (e.g. constant tension) may be used to draw in the cable as required to effect rotation about the first axis.

The ends of drive cable 50 may be attached to attachment points located at the top portion of grooved arcs 62, 64 rather than on the bottom as shown. In this configuration, the minature rod and pulley assemblies would be turned upside down (from the positions shown) and the cable would pass only between the pulley and the grooved arc rather than almost completely around the pulleys as shown. More cable friction and higher stiffness may result from this.

The minature rod and pulley assembly may incorporate ball bearings to replace the rubbing surfaces encountered by the cable as the load turns over. The ball bearings may be two units inserted right into the end of the rod of the rod and pulley assembly.

The angle sensing potentiometer 68 for the cable axis shown on pulley 52 may instead be incorporated into one of the rods 40 at its top ball joint. In this configuration, the angle sensing housing would be fixed inside the load body and the angle sensor input shaft would extend radially out from the load's center of rotation. This shaft would interface with the rod end through a yoke and pin arrangement which would provide a ball joint like action but which would rotate the shaft by exactly the same angle as the load is rotating. This arrangement may be more accurate and would not be as susceptible to stretch.

The bottom joint attachment for rods 40 need have only a single axis of freedom as in a yoke and pin rather than a universal or ball and socket connection as shown.

Furthermore, the rods 40 can each be divided into a pair of rods fastened together in a square framework such that when they are pushed up and down, the load may pass therebetween—rather than, for some loads, possibly hitting a single centrally located rod 40 as shown in the exemplary embodiment. This configuration allows greater angular range on the "rod" axis of rotation without the need to cut away part of the load structure (or otherwise cause it to be specially shaped). Thus it is possible by this alternate configuration to accommodate a spherical load over wide angular ranges (e.g. $\pm 65°$ on the first (rod) axis and $\pm 80°$ on the second (cable) axis).

As should now be apparent, the use of the strategically placed rod and pulley assemblies 80 enables the cable to drive the second (i.e. cable) axis while permitting the cable to leave the pulley at different directions as required while the load is moved about the first (i.e. rod) axis. This is considered an important and advantageous feature.

While the invention has been described in connection with what is presently considered to be the most practical and preferred embodiments, it is to be understood that the invention is not to be limited to the disclosed embodiments but on the contrary, is intended to cover the modifications and variations which retain novel advantageous features of this invention. The appended claims are intended to encompass all such modifications and variations.

What is claimed is:

1. A gimballed load mounting apparatus comprising:

means for rotationally driving a load about a first axis; and cable means for supporting said load at a pair of spaced-apart support points disposed along said first axis and for rotationally driving said load about a second axis orthogonal to said first axis, said cable means including a driven cable passing about a pulley mounted substantially in line with said first axis and also along an arcuate path concentric with said second axis, said arcuate path being disposed in a predetermined plane fixed with respect to said load whereby the cable leaves the pulley at a variable angle with respect to said plane, said angle being dependent upon the position of the load with respect to the first axis.

2. A biaxial gimbal arrangement for gimballing a load, said arrangement comprising:

a load mount having thereon an arcuate path lying in a predetermined plane;

means defining orthogonal first and second axes about which said load mount can rotate, said second axis being perpendicular to said plane and passing through the center of rotation of said arcuate path;

a first motor;

drive means, coupled to said first motor and to said load mount for rotating said load mount about said first axis;

a second motor;

cable means, coupled to said second motor and to said load mount, for rotating said load bearing member about said second axis, said cable means including a cable having at least one end that is passed through the first axis at a predetermined point and thereafter on said arcuate path coaxial with said second axis on its way to an anchor point on said load mount.

3. An arrangement according to claim 2 further comprising means for indicating the rotation position of said load mount about said first axis.

4. An arrangement according to claim 2 further comprising means for indicating the rotation position of said load mount about said second axis.

5. An arrangement according to claim 1 wherein said cable means further comprises a drive pulley mounted for rotation by said second motor, said cable being looped at a central portion thereof about said drive pulley.

6. A biaxial gimbal arrangement for gimballing a load, said arrangement comprising:

a frame;

a load mount;

means defining two orthogonal axes which intersect at a virtual gimbal point about which said load mount can rotate with respect to either axis;

a first motor affixed to said frame for producing mechanical movements with respect to said frame;

push rod means, coupled to said first motor and to said load mount for rotating said load mount about said first axis;

a second motor also affixed to said frame for producing mechanical movements with respect to said frame;

cable means, coupled to said second motor and to said load mount, for rotating said load bearing member about said second axis and including a flexible cable which passes through two spaced apart points which are colinear with said virtual gimbal point.

7. A gimballed mounting apparatus comprising:

a load member having an arcuate guideway formed about at least a portion thereof;

mounting means moveably engaged with said guideway to support the load member at two opposing points defining a first rotational axis through said two opposing points and a second rotational axis through the center of said arcuate guideway, said second axis being orthogonal to said first axis; and drive means coupled to said load member for independently causing rotational motion of the load member about said first and second axes, said drive means including a driven flexible cable which passes through said first axis while driving rotational motion about said second axis.

8. A gimballed mounting apparatus as in claim 7 wherein said drive means includes at least one driven push rod and ball joint assembly connected to said load member at a point along said second axis while driving rotational motion about said first axis.

9. A biaxial gimbal mounting arrangement for gimballing a load in two rotational axes comprising:

a rigid frame;

two support members rigidly attached to said frame;

a load support member adapted to receive and support a load and having a grooved arc at least partially thereabout;

a pair of rod and pulley assemblies coupled one each to said support members and disposed at least partially within said grooved arc, a line between said rod and pulley assemblies defining a first axis for rotation of said load support member about said rod and pulley assemblies;

a rod driving motor rigidly attached to said frame;

a rod drive arm pivotally driven by said rod driving motor;

a pair of push rod assemblies each having a first end coupled to said rod drive arm and each having a second end attached to said load support member, the points of attachment to said load support member forming a second axis centered within said arc groove for rotation of said load support member orthogonal to said first axis;

a cable motor rigidly coupled to said frame for providing power to rotate said load support member about said second axis, rotation about said second axis changing the relative position of said rod and pulley assemblies within said grooved arc; and a cable arrangement for transmitting power from said cable motor to said load support member through said rod and pulley assemblies for rotating said load support member about said second axis.

10. A biaxial gimbal mounting arrangement according to claim 9 wherein said cable arrangement comprises:

a drive pulley rotatably mounted to said frame and coupled to said cable motor so as to be rotated thereby; and a cable having first and second ends attached to said load support member and looped about said drive pulley and both of said rod and pulley assemblies for rotating said load support member about said second axis.

11. A biaxial gimbal mounting arrangement according to claim 9 wherein each of said push rod assemblies comprises a push rod having first and second ends and ball joint coupling said first end of said push rod to said load support member.

12. A biaxial gimbal mounting arrangement according to claim 10 wherein said cable arrangement further comprises an idler pulley about which said cable is looped.

13. A biaxial gimbal mounting arrangement according to claim 10 further comprising means for indicating the instantaneous angular position of said load support member about said first axis.

14. A biaxial gimbal mounting arrangment according to claim 9 further comprising means for indicating the instantaneous angular position of said load support member about said second axis.

15. A biaxial gimbal mounting arrangement according to claim 13 wherein said angular position indicating means comprises a potentiometer fixedly mounted with respect to said frame and having a rotatable shaft coupled to said rod driving motor for providing an electrical resistance that is varied as a function of the position of said rod drive arm and hence the angular position of said load support member about said first axis.

16. A biaxial gimbal mounting arrangement according to claim 14 wherein said angular position indicating means comprises a potentiometer having a body fixedly mounted with respect to said frame and having a rotatable shaft driven by said cable arrangement for providing an electrical resistance that is varied as a function of the cable position and hence the angular position of said load support member about said second axis.

17. A method for gimballing a load about at least two orthogonal axes which intersect within the gimballed load, said method comprising the steps of:

partially controlling the load position at a first two spaced-apart opposing points on an arcuate guideway, a first rotational axis for the load being defined by a line through said first two opposing points;

further controlling the load position at a second two spaced-apart opposing points along a line passing through the center of said arcuate guideway thereby defining a second rotational axis for the load along a line through said second two opposing points;

driving a flexible cable passing through said first axis at said first two spaced-apart opposing points to control rotational movement about said second axis; and driving at least one of said second two opposing points to control rotational movement about said first axis.

18. A method for gimballing a load about at least two orthogonal axes, said method comprising the steps of:

driving said load with rotational movements about a first axis, and driving said load with rotational movements about a second axis orthogonal to said first axis by using a driven flexible cable passing over a pulley, substantially through said first axis and about an arcuate path which is contained within a plane that is, in turn, fixed with respect to said load wherein the cable defines an angle with said plane and therefore with itself where it passes through said first axis, which angle varies dependent upon the position of the load with respect to the first axis.

19. A biaxial gimballed load mounting apparatus comprising:

a load mount;

bearing means engaged with said load mount for permitting rotational movements thereof about a first axis;

first axis drive means drivingly attached with said load mount at at least one predetermined point for moving it about said first axis;

said load mount including an arcuate guideway means disposed about at least a portion thereof and being concentric with a second rotational axis, perpendicular to and intersecting with said first axis, said second axis also passing through said predetermined point where said first axis drive means is attached to said load mount;

said bearing means also being movably received by said arcuate guideway means and thereby permitting simultaneous rotational motion of said load mount about said second axis;

a cable driving means; and a flexible cable passing from an anchor point on the load mount and along said arcuate guideway means to a point substantially on said first axis and then to said cable driving means whereby the load mount is rotationally driven about said second axis by said cable driving means.

20. A biaxial gimballed load mounting apparatus as in claim 19 wherein said bearing means includes a cable pulley as a part thereof, said cable passing about said pulley at the location where the cable leaves said arcuate guideway and passes, at a variable relative angle, to the cable driving means, said relative angle directly corresponding to the load mount position about said first axis.

* * * * *